United States Patent [19]

Jones

[11] 3,986,308

[45] Oct. 19, 1976

[54] MAUSOLEUM CRYPT LINER THEREFOR AND METHOD OF CONSTRUCTION

[76] Inventor: Henry L. Jones, 655 N. Brea Blvd., Brea, Calif. 92621

[22] Filed: Jan. 12, 1976

[21] Appl. No.: 648,194

[52] U.S. Cl. ..... 52/134; 52/136; 52/745

[51] Int. Cl.[2] ..... E04H 13/00

[58] Field of Search ..... 52/79, 134, 136, 138, 52/741, 745

[56] References Cited

UNITED STATES PATENTS

| | | | |
|---|---|---|---|
| 919,126 | 4/1909 | Chesrown | 52/134 |
| 980,750 | 1/1911 | Blyth | 52/136 |
| 1,167,888 | 1/1916 | Clock | 52/136 |
| 1,300,173 | 4/1919 | Kennedy | 52/136 |
| 3,076,292 | 2/1963 | Arbogast | 52/136 |
| 3,287,865 | 11/1966 | Lockman | 52/136 |
| 3,331,170 | 7/1967 | Lowe et al. | 52/79 |

FOREIGN PATENTS OR APPLICATIONS

| | | | |
|---|---|---|---|
| 2,210,342 | 9/1973 | Germany | 52/79 |

*Primary Examiner*—Alfred C. Perham
*Attorney, Agent, or Firm*—Lyon & Lyon

[57] ABSTRACT

A mausoleum and method of construction utilizing a series of crypt liners, each preformed of two identical components having marginal portions arranged to be sealed together to form an enclosure open at its front end, the crypt liners having laterally extending side tabs perforated to receive fasteners so as to position the crypt liners in predetermined side-by-side relationship on an underlying slab; the crypt liners also including laterally extending front tabs for removable attachment to a casting frame. The crypt liners adapted to be arranged in a row, one unit high on an underlying slab, with their open ends in contact with, and supported by the casting form, whereby concrete may be poured around and over the crypt liners to permanently encase the vault liners and form a second slab for supporting a second row of vault liners, this procedure being repeated until the vault liners form columns of the desired height. Upon removal of the casting form, the front ends of the vault liners are essentially flush with the concrete surface and receive conventional fasteners to support a facade of marble or the like divided into a removable unit for each crypt. As each crypt is used, a seal slab is permanently fitted in and sealed over the open end of the vault. The concrete is suitable reinforced and as the crypt liners are set in place, each crypt is connected to a venting system.

9 Claims, 8 Drawing Figures

MAUSOLEUM CRYPT LINER THEREFOR AND METHOD OF CONSTRUCTION

BACKGROUND

Mausoleums which are provided with multiple rows and columns of vaults are recognized as increasing in importance; however, the cost of construction is substantial, often requiring a large number of crypts in order to reduce the cost per vault, thus limiting its use to larger urban areas. Attempts have been made to reduce cost by prefabricating portions of the mausoleums without, however resulting in significant reduction in cost, and often the resulting structure is unattractive. Representative of the prior art in mausoleum constructions are the disclosures in the following U.S. Pat. Nos.: 919,126; 980,750; 1,167,888; 1,300,173.

SUMMARY

The present invention is directed to a mausoleum, crypt liner therefor and method of construction which overcomes the disadvantages of previous mausoleums and is summarized in the following objects:

First, to provide a crypt liner for mausoleums which comprises a pair of identical complementary components which are readily sealed together to form an enclosure open at its front end, the front end having tabs for removable attachment to a casting form, and having along opposite sides other laterally extending tabs, the tabs of adjacent crypt liners being joined to secure the crypt liners permanently in predetermined spaced and fixed relation.

Second, to provide a method of constructing mausoleums utilizing the crypt liners as indicated in the previous object, wherein a row of liners are placed on a previously poured concrete slab, and following attachment of the liners to the casting form, concrete is poured between and over the row of crypt liners to form a second slab for receiving a second row of crypt liners, this procedure being repeated until predetermined columns of crypt liners have been encased.

Third, to provide a means and method of constructing mausoleums wherein appropriate reinforcing may be set in place between the crypt liners, and wherein a venting system may be readily installed as each row of crypt liners is set in place.

Fourth, to provide a means and method of constructing mausoleums wherein the exposed concrete wall surrounding the front ends of the rows and columns may receive appropriate conventional mounting fittings for removable placement of conventional facade units formed of marble or the like in overlying relation to the front ends of the crypt.

Fifth, to provide a mausoleum as indicated in the preceeding object wherein cover plates are provided for the crypt liners which are arranged to be sealed in place following placement of a casket in the crypt.

Sixth, to provide a crypt liner as indicated in the first object wherein the side tabs are provided with pin receiving apertures so spaced as to secure the crypt liners in parallel relation, whereby the front ends are coplanar, or so spaced as to secure the crypt liners in slightly converging relation to define a cylindrical area.

DETAILED DESCRIPTION

Figure 1:
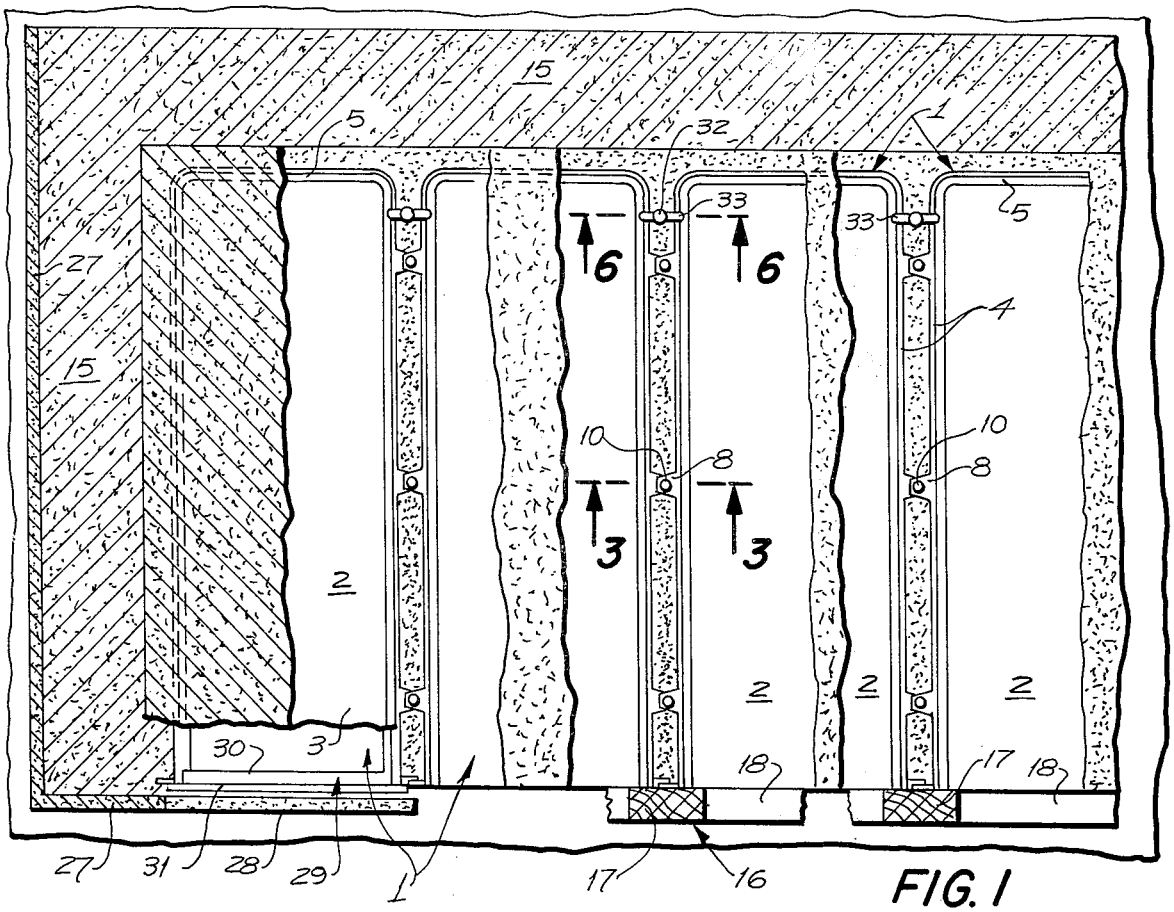
FIG. 1 is a fragmentary plan view with portions in section and showing various stages in the construction of the mausoleum.

The mausoleum utilizes a plurality of crypt liners 1 each crypt liner comprising a pair of identical liner components 2. Each component includes a wall 3 which may function as the bottom or top wall of the crypt liner and further includes a pair of side walls 4 and a back end wall 5.

The side walls and end walls of each component is provided with a flange 6. The components are joined together by placing one over the other with their flanges 6 in mutual engagement. The flanges are provided with mating grooves and channels 7 so that they may be readily fitted one to the other in sealing relation, as well as secured together by an appropriate adhesive, or combination sealant and adhesive.

Extending from the flange of one of the side walls 4 of each component is a set of side webs 8. The components 2 are so arranged that when one component is placed over the other, the side webs 8 extend from opposite sides of the assembled liner 1. The side webs are provided with perforations 9 so that when the crypt liners are placed side by side their relative position may be fixed by connecting pins 10 extended through the perforations 9.

The outer extremities of the liner components are provided with laterally extending end tabs 11 which may be arranged so that the end tabs of adjacent crypt liners overlap, in which case one end tab is provided with an offset portion 12. Alternatively, the end tabs may be disposed in confronting, rather than overlapping relation. In either case the end tabs are provided with perforations 13 to receive nails 14 or other securing means.

The method of constructing a mausoleum utilizing the crypt liners involves the construction of appropriate mausoleum walls 15 which enclose the back and ends of a row of crypt liners. At the remaining or outer side a form structure 16 is provided and comprises vertical members 17 joined by horizontal members 18, the vertical and horizontal members are positioned so as to frame rows and columns of the crypt liners as they are assembled within the mausoleum walls.

Initially, a bottom or foundation slab 19 is poured and its surface smoothed to receive a row of crypt liners joined by the side webs 8 and pins 10. The form structure 16 is so positioned that its vertical members bridge between adjacent crypt liners 1 and the crypt liners are secured in position against the form structure by means of the nails 14. Other securing means, such as appropriate bolts, may be used.

Figure 2:
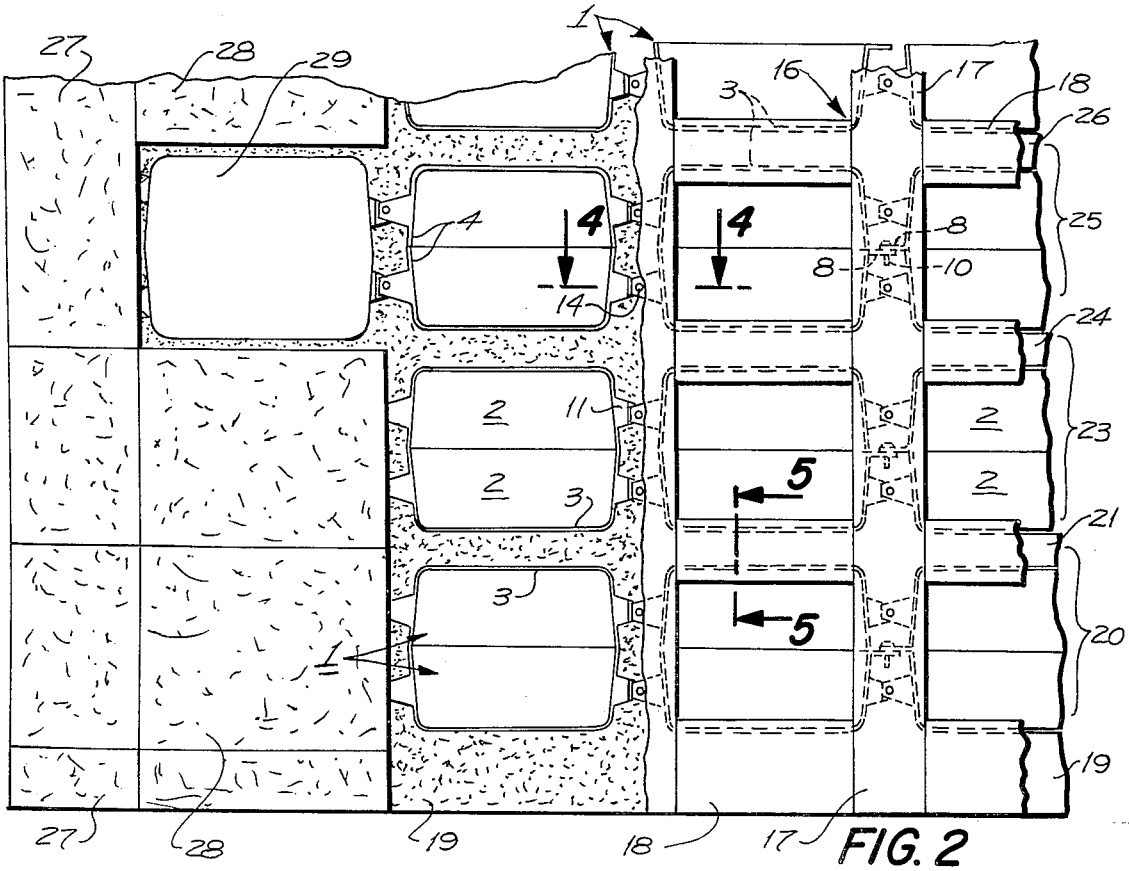
FIG. 2 is a fragmentary front view also showing various stages in the construction of the mausoleum.
Figure 3:
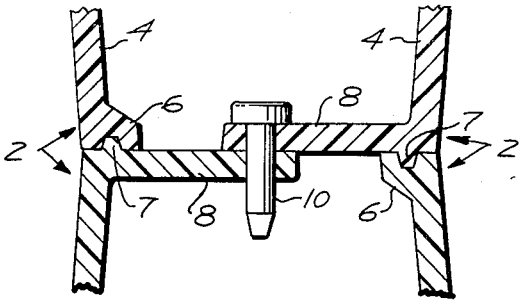
FIG. 3 is an enlarged fragmentary sectional view taken through 3—3 of FIG. 1.
Figure 5:
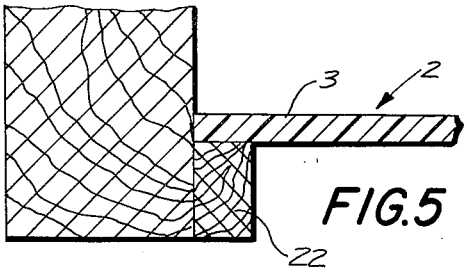
FIG. 5 is an enlarged fragmentary sectional view taken through 5—5 of FIG. 2.
Figure 4:
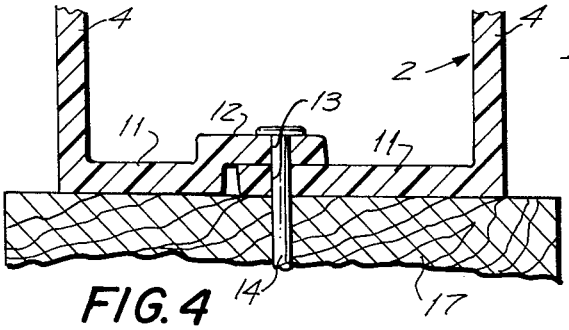
FIG. 4 is an enlarged fragmentary sectional view taken through 4—4 of FIG. 2.

After the first row of crypt liners are in place, a first concrete pour 20 is made which fills between the vault liners and across the inner ends thereof, as indicated in FIG. 2. The pour is continued until a slab 21 is formed above the first row of crypt liners. To prevent collapse of the upper wall of each crypt liner, a cleat 22 secured to the corresponding horizontal member 18 extends under the outer edge of the upper wall, as shown in FIG. 5.

After the first pour has set, a second row of crypt liners is positioned and a second pour 23 forming a second slab 24. Again, after positioning the crypt liners, a third concrete pour 25 forming a third slab 26 is applied, this procedure is repeated until the desired height is reached.

The liner components, before being assembled, are so arranged that they may be stacked to the extent permitted by the outer end tabs 11, also for storage and shipping the open front ends may be provided with removable or severable across braces, not shown.

After installation of the rows and columns of the crypt liners has been completed, the form structure 16 is removed.

The positioning of the crypts as accomplished by use of the crypt liners is essentially the same dimensionally as the crypts of conventional mausoleums. The outer ends of the crypt liners are essentially flush with the wall of the mausoleum formed therebetween and are capable of being concealed in a conventional manner by an appropriate facade 27, a common practice is to provide a removable facade member 28 dimensioned to cover a corresponding crypt. Usually the facade members are arranged in contiguous relation and are removably secured by conventional fastening elements, not shown, secured in the surface of the mausoleum wall.

Each crypt liner 1 receives a front sealing panel or slab 29 which may be formed of concrete and which is not secured in place until the particular crypt is occupied. Upon placement of the coffin in the crypt the sealing panel which has a sealing lip 30 and flange 31 is appropriately coated with a sealing and adhesive, then secured in place whereupon the facade member 28 which has been previously removed, is replaced.

Figure 8:
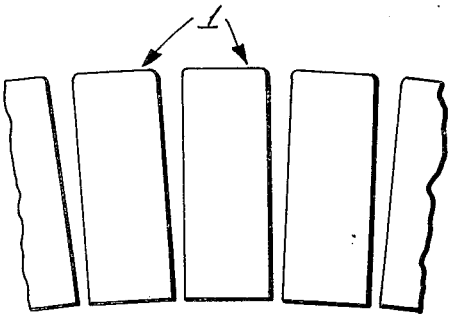
FIG. 8 is a diagrammatical plan view showing several crypt liners forming a portion of a circular structure.

The tabs 8 serve to place the crypt liners in proper relation to each other and align the crypt liners in proper relation to the form structure 16. Also, by encasing one row of crypt liners at a time the construction of the mausoleum is greatly simplified. While conventional mausoleums locate the crypts in coplanar relation, it is possible merely by changing the effective lengths of the tabs to arrange the crypt liners in converging relation, as shown in FIG. 8, permitting the crypts to be arranged in a circle.

Figure 6:
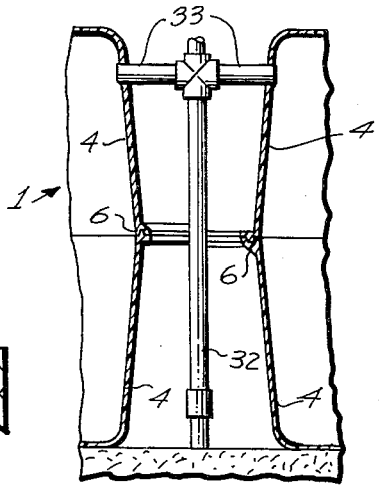
FIG. 6 is an enlarged fragmentary sectional view taken through 6—6 of FIG. 1.
Figure 7:
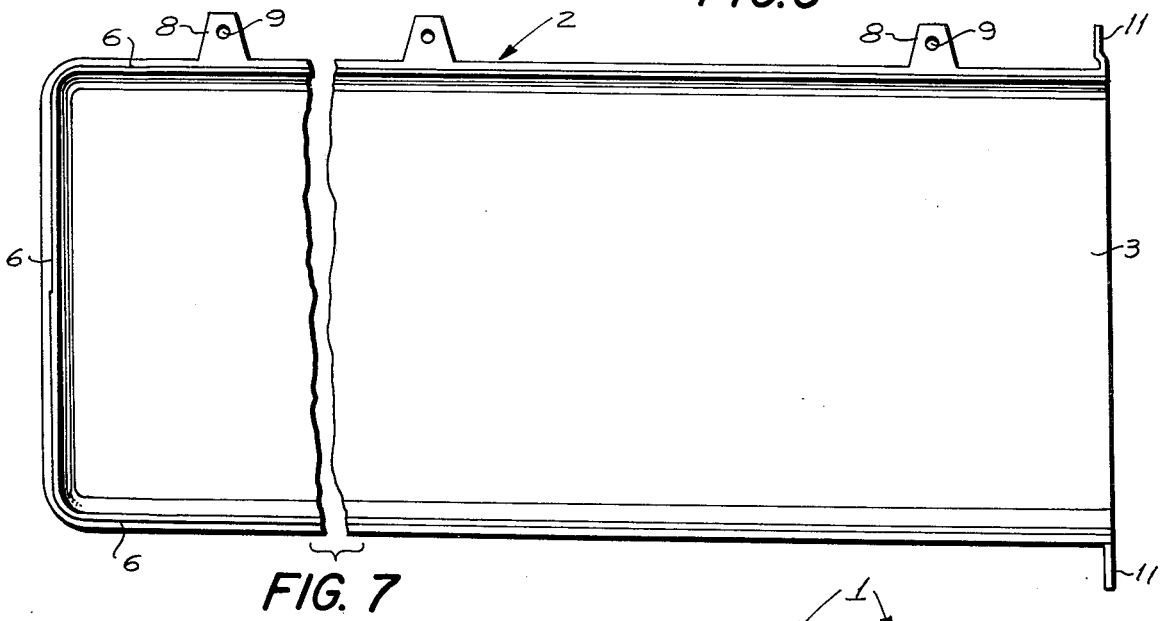
FIG. 7 is a fragmentary plan view of one of the crypt liner components.

The means and method herein described may be readily provided with vent lines 32 between pairs of crypt liners and connect them thereto by crossfittings 33, as indicated in FIGS. 1 and 6. The vent lines 32 may be divided vertically so that vent line segments are installed with each row of crypt liners.

It should be noted that, while each crypt liner 1 herein described is intended to receive a single coffin, the crypt liner may be molded so as to be twice the length indicated so as to receive two coffins in tandem. In this case the front sealing panel may be removable.

It should be noted that the present invention is directed primarily to mausoleums which are constructed above ground level. However, the structure may be installed below ground level with a passageway in front of the mausoleum and between confronting mausoleums.

Having fully described my invention it is to be understood that I am not to be limited to the details herein set forth, but that my invention is of the full scope of the appended claims.

I claim:

1. A mausoleum utilizing a facade including rows and columns of removable facade units, the mausoleum comprising:

a. rows and columns of crypts having open outer ends in registry with the removable facade units;

b. a permanent liner for each crypt;

c. spacing tabs projecting from each crypt liner;

d. connecting means joining the tabs of a row of crypt liners to initially position the crypt liners in fixed relation;

e. a solid, initially fluid material encasing each row of crypt liners.

2. A mausoleum as defined in claim 1, wherein:

a. each crypt liner includes a pair of essentially identical components; each including side walls and an inner end wall sealed together.

3. A mausoleum as defined in claim 1, wherein:

a. the crypt liners are in parallel relation and their front ends define a plane.

4. A mausoleum as defined in claim 1, wherein:

a. the crypt liners converge toward their open ends to define an essentially cylindrical surface.

5. A mausoleum as defined in claim 1, wherein:

a. a seal slab is provided for each crypt liner in registry with a corresponding removable facade unit.

6. A permanent crypt liner adapted to be cast in place to form a mausoleum having rows and columns of crypts, said crypt liner comprising:

a. a pair of complementary crypt liner components, each including a main wall, a pair of opposed side walls, and an inner end wall;

b. the components having flange elements bordering the side and end walls adapted for mating and sealing engagement upon inverting one component over the other, the main walls of the components forming respectively a bottom wall and top wall;

c. a set of side tabs projecting from the assembled crypt liner;

d. and means joining the side tabs to position a row of the crypt liners in fixed spaced relation.

7. A permanent crypt liner as defined in claim 6, wherein a casting form is used to form the front face of the mausoleum, wherein:

a. a set of front end tabs project laterally from the crypt liners;

b. and means is provided for attaching the front end tabs to the casting form.

8. A permanent crypt liner as defined in claim 6, wherein:

a. a seal slab is provided for the outer end of each crypt liner.

9. A method of constructing a mausoleum utilizing a plurality of crypt liners, each liner comprising a pair of complementary liner components having side tabs adapted to be joined together to form a row of crypt liners disposed in predetermined spaced relation, the method characterized by:

a. arranging casting forms delineating the area intended to receive the crypt liners;

b. casting an initial slab;

c. positioning a first row of crypt liners thereon with their front ends contiguous to one of the casting forms;

d. casting a second slab between and over the first row of crypt liners to form a second slab surface;

e. positioning a second row of crypt liners on the second slab in the manner of the first row of vault liners;

f. and casting additional slabs in sequence over additional rows of crypt liners.

* * * * *